US007463838B2

(12) United States Patent
Chan

(10) Patent No.: US 7,463,838 B2
(45) Date of Patent: Dec. 9, 2008

(54) MARKING MATERIAL CARTRIDGE WITH AUTOMATIC HIGH YIELD FUNCTION INDEPENDENT OF HOST PRINTING DEVICE

(75) Inventor: Alan K. Chan, Fairport, NY (US)

(73) Assignee: Nu-Kote International, Inc., Rochester, NY (US)

( * ) Notice: Subject to any disclaimer, the term of this patent is extended or adjusted under 35 U.S.C. 154(b) by 157 days.

(21) Appl. No.: 11/633,771

(22) Filed: Dec. 4, 2006

(65) Prior Publication Data

US 2008/0131147 A1 Jun. 5, 2008

(51) Int. Cl.
*G03G 15/00* (2006.01)
*G03G 15/06* (2006.01)
*B41J 2/195* (2006.01)

(52) U.S. Cl. ..... 399/27; 347/7; 399/111; 399/262

(58) Field of Classification Search ..... 399/27, 399/82, 111, 119, 120, 262; 347/9, 49, 86, 347/7

See application file for complete search history.

(56) References Cited

U.S. PATENT DOCUMENTS

| | | | | |
|---|---|---|---|---|
| 6,532,351 | B2 | 3/2003 | Richards et al. | |
| 6,757,071 | B1 | 6/2004 | Goodman et al. | |
| 7,099,606 | B2 | 8/2006 | Karagiannis et al. | |
| 2002/0154915 | A1 * | 10/2002 | Bullock et al. | 399/27 X |
| 2004/0207668 | A1 | 10/2004 | Adkins et al. | |

OTHER PUBLICATIONS

International Search Report, PCT/US2007/086409, Jan. 2004.

* cited by examiner

*Primary Examiner*—Sophia S Chen
(74) *Attorney, Agent, or Firm*—Fay Sharpe LLP

(57) ABSTRACT

A replaceable consumable for use in an associated printing device is provided wherein the consumable includes an electronic member having a memory element storing marking material quantity data corresponding to a quantity of marking material contained in the cartridge body and being responsive to data maintenance signals from the printing apparatus to modify the marking material quantity data in the memory element as a non-linear function of the data maintenance signal.

30 Claims, 10 Drawing Sheets

MARKING MATERIAL CARTRIDGE WITH AUTOMATIC HIGH YIELD FUNCTION INDEPENDENT OF HOST PRINTING DEVICE

BACKGROUND

This application relates to replaceable consumable devices for use with printing apparatus having the ability to read and write data relating to a quantity of marking material contained within the replaceable consumable. More particularly, the subject application relates to ink and toner cartridges having an enhanced storage capacity ink or toner usage efficiency and electronics for interfacing with the associated printing apparatus to store the data relating to a quantity of the marking material. However, it is to be appreciated that the present exemplary embodiments may find use in related and other environments and applications where replaceable cartridges holding consumable materials are used.

It is generally well known in the art to provide ink and toner cartridges with electronic devices storing various data which is useful to the printing device in executing print functions. One form of data used in the past includes data representative of a type of marking material contained in the cartridge. That data is first read by the printing apparatus from electronics carried on the cartridge and is then used to set operational printing parameters within the printing apparatus. This technique best assures that any changes in the chemistry or composition of the marking material are accommodated in the printing apparatus such as by adjusting an amount of power supplied to print heads or fuser stations for generating printed documents having a high quality.

Another form of data commonly stored in electronic devices carried on cartridges includes marking material quantity data. Data of this type is essentially data representative of either an amount of marking material consumed from the cartridge or an amount of marking material remaining in the cartridge at any given time. Typically, both of these were represented as percentages of a completely full cartridge capacity value or of a completely empty cartridge capacity value. In either case, the marking material quantity data is used directly by the printing application to determine a projected printed page capability by calculating a product of a stored value representative of a full quantity of material with the percentage data value obtained from the cartridge multiplied by a constant representative of an average page count per given unit of marking material. During a printer initialization cycle, the marking material quantity data is retrieved from the electronic storage portion of the cartridge and copied into a memory location resident in the printing apparatus. During ensuing printing operations, the printing apparatus either deducts from the remaining material quantity data or adds to the marking material consumed data to keep an accurate account of the depletion state of the consumable cartridge. In some prior art printer and consumable cartridge systems, the printer periodically writes the marking material quantity data to the cartridge memory according to a regular predetermined schedule. In other prior art systems, the printing apparatus simply writes back the consumable quantity data during a power down cycle.

It is important for printing devices to suspend or terminate printing operations well before a complete exhaustion of the marking material. In some cases, such as in ink jet printing, the marking fluid is used to cool the printhead and without it, damage would occur. In other examples, it is important to discourage the formation of bubbles entrained in the fluid conduit system conveying marking material between the replaceable consumable and the printing device. It is important there as well to terminate printing operations well before those systems run dry. In toner based printing systems, it is important to be sure that the printing apparatus always has a supply of toner so that the developer and fusing stations are not adversely affected such as when those systems run dry.

Many original equipment manufacturers (OEMs) adopt a conservative approach to preventing their printing apparatus from running dry. One example of such an approach includes a method of monitoring of the marking material quantity data and terminating printing operations when the marking material quantity data reaches a minimum threshold value, typically of about 20% marking material remaining. As an example, in marking systems with cartridges holding 20 ml. of ink, the printing is terminated when the ink remaining data reaches about 20% of the total or, when the amount of ink remaining in the cartridge is about 4 ml. Of course, this is wasteful but, as noted above, provides an extremely conservative approach. This large amount of ink remaining in the cartridge after the printing apparatus has determined the cartridge to be useless is a significant amount of otherwise valuable product which was paid for by the consumer and which would eventually form part of a landfill.

Oftentimes consumers and other owners of ink cartridges desire to fill those cartridges with marking material in excess of an original quantity of marking material typically supplied by the OEM. In the example above, the consumer might try to fill the cartridge with 24 ml. of ink, rather than with the standard 20 ml. supplied by OEM. It would seem to the consumer that this would be useful for purposes of minimizing the amount of time spent in replacing cartridges and maximizing the page count between cartridge changes to enhance business productivity. However, simply adding additional marking material to the cartridge has no effect on the total number of pages of printed production from that cartridge because, as noted above, the printing apparatus typically decrement/increment the marking material data represented as a percentage of a completely filled or a completely empty state until a predetermined threshold is reached whereupon further printing operations are terminated. In the above example, the printer is programmed to behave as if 20 ml. are present and to consume up to 16 ml., thus leaving 8 ml. of unused ink in the tank. This is extremely wasteful because the additional amount of marking material added by the consumer or owner is not used and, further, the original amount of marking material as specified by the OEM is not used either.

However, it remains highly desirable for consumers and owners of those cartridges to refill them at a capacity in excess of the OEM specifications. Typically this refill is performed by simply adding additional marking material in void spaces in the original unaltered cartridge. Another approach is to modify the OEM cartridge slightly by adding a large bin or storage capacity structure to accommodate additional marking material. Thereafter, the electronics on the cartridges are reset to a full value even tough a substantial portion of the material has been depleted. This is, of course, risky because as explained above, the print heads can be overheated and damaged.

In either case, again, it is highly desirable to provide an enhanced marking material capacity.

SUMMARY OF THE INVENTION

The present application provides a replaceable consumable for use in an associated printing device wherein the consumable includes an electronic member having a memory element storing marking material quantity data corresponding to a quantity of marking material contained in the cartridge body and being responsive to data maintenance signals from the printing apparatus to modify the marking material quantity data in the memory element as a non-linear function of the data maintenance signal.

A primary advantage of the invention resides in the ability to fully utilize all of the marking material contained in the consumable obtained from the OEM.

Another primary advantage of the invention resides in the ability for consumers and owners of marking material cartridges to refill those cartridges with marking material quantities in excess of those provided by the OEM.

Yet a further primary advantage of the invention resides in the ability of consumers and owners of marking material cartridges to modify those cartridges to accommodate larger marking material capacities beyond those provided for by the OEM.

Still other advantages and benefits of the invention will become apparent to those skilled in the art upon reading and understanding the following detailed description.

BRIEF DESCRIPTION OF THE DRAWINGS

The invention may take form in certain parts, components, structures, and steps, the preferred embodiments of which will be illustrated in the accompanying drawings.

DETAILED DESCRIPTION OF THE PREFERRED EMBODIMENTS

Figure 1:
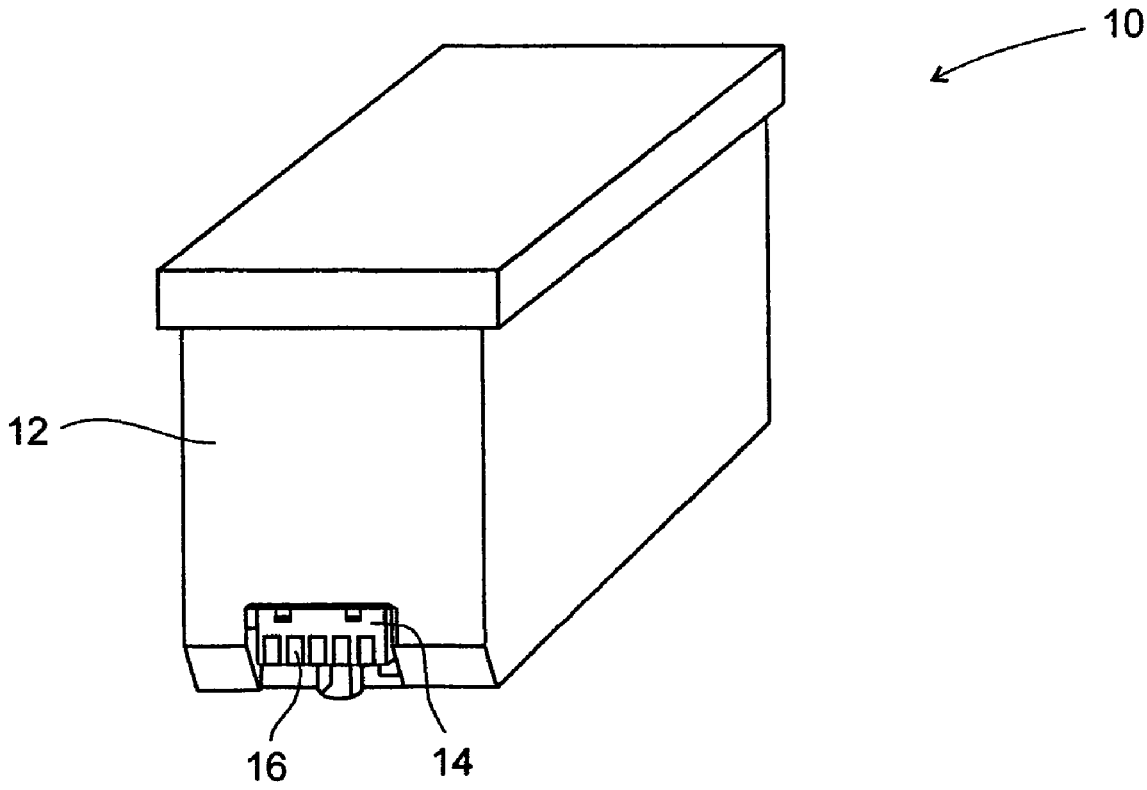
FIG .1 PRIOR ART
FIG. 1 is a perspective view illustrating a structure of a consumable device carrying a semiconductor memory device in accordance with the prior art.

Turning now to the drawings, FIG. 1, is a perspective view illustrating an ink cartridge carrying a semiconductor memory device in accordance with well known prior art methods. As shown there, an ink cartridge 10 has a cartridge main body 12, typically composed of a synthetic resin such as plastic. The main body 12 defines an inner chamber for holding a consumable marking material therein, such as, for example, ink. In toner cartridge consumables, of course, the chamber is adapted to store toner particles or material. In typical cartridges, a storage element 14 is carried on the cartridge main body 12 at a location suitable for engagement with an associated printing apparatus when the cartridge 10 is inserted therein. The storage element 14 carries out transmission of various data to and from the associate printing device (not shown) when the ink cartridge is suitably attached to a carriage attachment unit, or the like of a main body of a printing apparatus. A plurality of electrical contacts 16 are formed on the storage element 14 so that data can be transmitted between the ink cartridge 10 and the associated printing apparatus using a pre-established protocol. The contacts are not needed when the cartridge uses a radio frequency connection. In that case, the storage element 14 includes an RF circuit portion adapted to transmit and receive radio frequency signals.

A wide variety of data is typically stored in the storage element 14 including data related to the cartridge such as cartridge ID, ink or toner volume remaining, ink or toner volume depleted, the version of the ink or toner cartridge, the year, month, date and time of manufacture, serial number, and so on. Also, data relating to the ink or toner contained within the chamber of the cartridge main body 12 is typically placed on the storage element 14. This includes data on a type of ink or toner contained therein and data on a remaining quantity or a depleted quantity of one or more ink or toner cartridges stored in the housing. As noted above, data on the remaining quantity or depleted quantity of marking material is most often stored as a percentage of a predetermined full or empty value.

Figure 2:
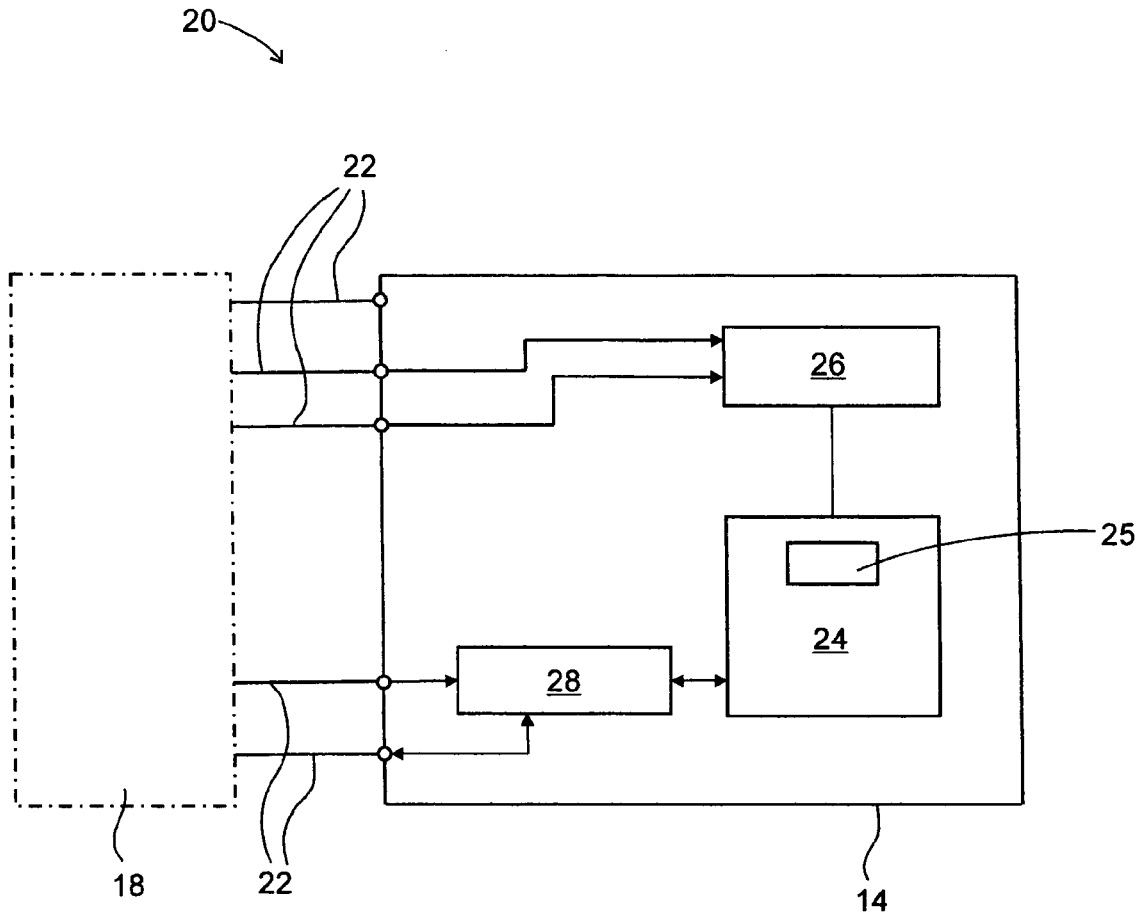
FIG. 2 PRIOR ART
FIG. 2 is a block diagram showing a configuration of a storage element incorporated in the consumable device of FIG. 1 in accordance with the prior art.

FIG. 2 shows a block diagram illustrating a configuration of a storage element incorporated in the ink cartridge of FIG. 1 in accordance with the prior art. As shown there, the storage element 14 is connected with the associated printing apparatus 18 using an electrical interface 20. Typically, the interface 20 includes a plurality of discrete contact-type signal and data communication lines 22 for interfacing the associated printing apparatus 18 with the storage element 14. In the illustrated prior art device, a memory array 24 is accessible to the printing apparatus 18 by means of an address counter 26 and a read/write controller 28. In the illustrated prior art device, all of the data written from the associated printing apparatus 18 into the storage element 14 is deposited into the memory array 24. One problem with this scheme, however, is that the system cannot accommodate enlarged or enhanced quantities of marking material data added to the cartridge body by consumers or owners of the cartridges. In systems of the prior art as shown, the consumer can fill the cartridge with ink beyond the level set by the OEM. However, since the data on a quantity of marking material 25 is stored in the memory 24 as a percentage of a full value specified by the OEM, the printer will not recognize the additional material added to the cartridge.

Figure 3:
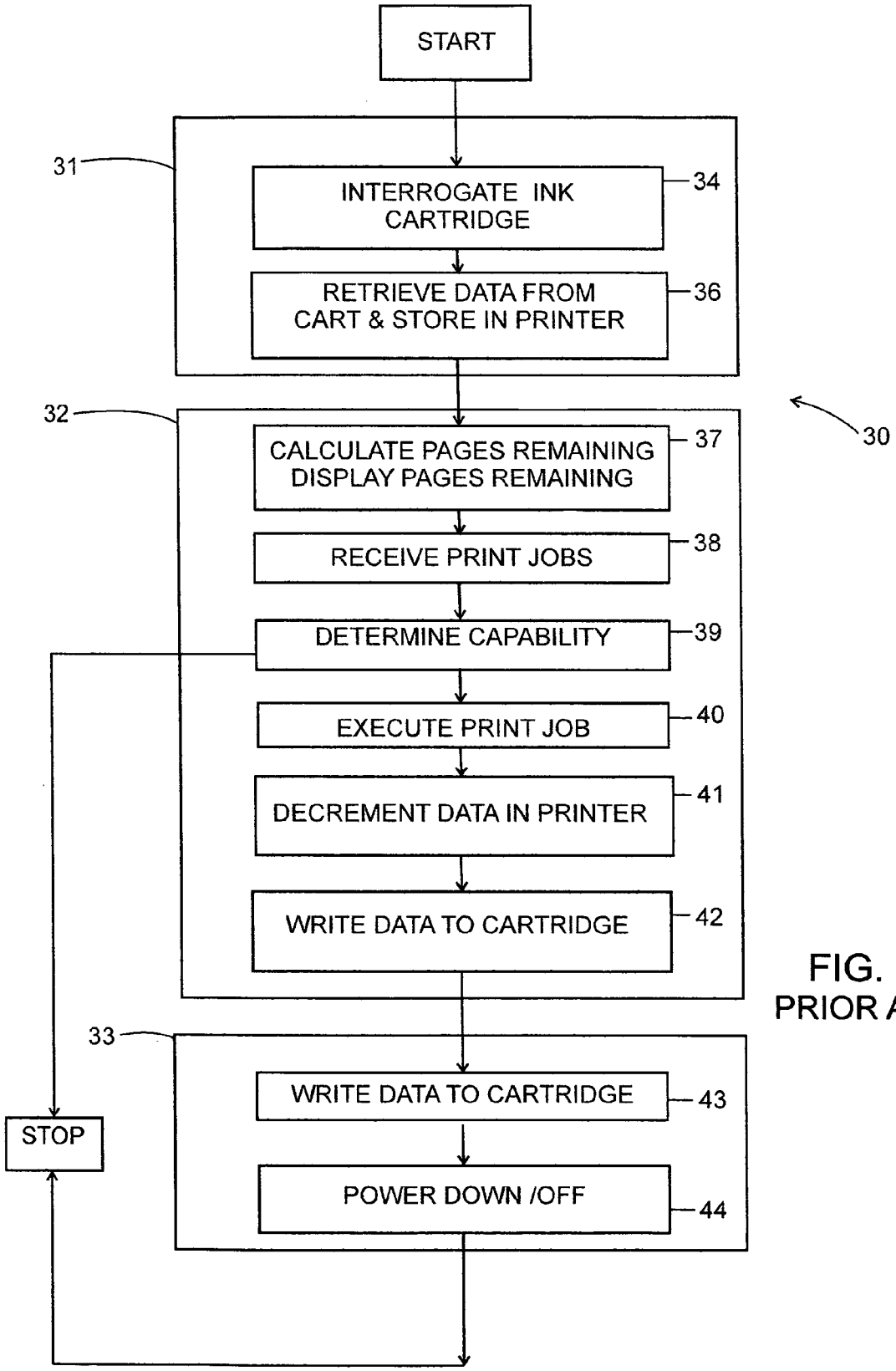
FIG. 3 PRIOR ART
FIG. 3 is a flow chart showing a method of operating a printing apparatus together with a consumable device in accordance with the prior art.

Turning next to FIG. 3, a flow chart showing a method of operating a printing apparatus together with a consumable device in accordance with the prior art is shown. With reference now to that figure, the prior art method 30 is logically grouped into three phases, namely an initialization phase 31, a consumption phase 32, and a power down phase 33. In the initialization phase 31, power is applied to the printing apparatus whereupon it interrogates the ink cartridge at step 34. During the interrogation step 34, the data contained in the storage element 14 of the ink cartridge 10 is read by the printing device 18 in order to make necessary compensations within the printing device and for purposes of determining the compatibility of the cartridge with the printing device. In step 36, the marking material quantity data is retrieved from the ink cartridge and stored into a memory resident in the printing apparatus 18.

Next, in the consumption phase 32, the total amount of pages remaining is calculated by the printing apparatus in step 37. At this point, the printing apparatus is readied for receiving print jobs at step 38. After print jobs are received from an associated computing device (not shown) the printing apparatus determines a capability of executing the print job at 39 based upon the calculated page remaining quantity as determined in step 37. The print job is executed at step 40 if a sufficient amount of marking material is present in the cartridge as determined in step 37. After execution of the print job, the marking material quantity data is decremented in the printer in step 41. Typically, the marking material remaining data is also written into the storage element 14 on the ink cartridge 10 in step 42. In that way, the printer apparatus develops a synchronization with the ink cartridge relative to the marking material remaining data.

Lastly, in the power down phase 33, a marking material remaining data quantity stored in the printing device is written to the cartridge at step 43. Thereafter, the printer executes a power down/off subroutine 44 to attend to various housekeeping needs and the like.

One disadvantage of prior art printing systems and, in particular, with prior art ink and toner cartridges of the type described above is that they suspend printing operations prematurely leaving a substantial amount of marking material unused in the cartridge. This is of course wasteful. Another disadvantage of these prior art systems is that they negate the ability of end users to fill empty cartridges with a quantity of marking material in excess of those provided by the OEM. Lastly, because these prior art systems operate on percentages of a predetermine quantity of marking material for all of the necessary calculations, modifications to the cartridges to increase the capacities thereof are rendered useless as well. The printers simply cannot recognize additional capacities added to cartridges of the prior art.

Therefore, in accordance with the present application, a marking material cartridge is provided with an automatic high yield function which operates independent of host printing devices. More particularly, the preferred embodiments of the subject invention selectively replace marking material quantity data received from the printing apparatus with a revised marking material quantity data representative of a non-zero incremental marking material quantity in excess of the overall marking material quantity supplied by the OEM. In that way, a one time adjustment is made to the material quantity data stored on the cartridge by incrementing marking material remaining data or decrementing marking material consumed data independent of the operations of the host printing device.

Figure 4A:
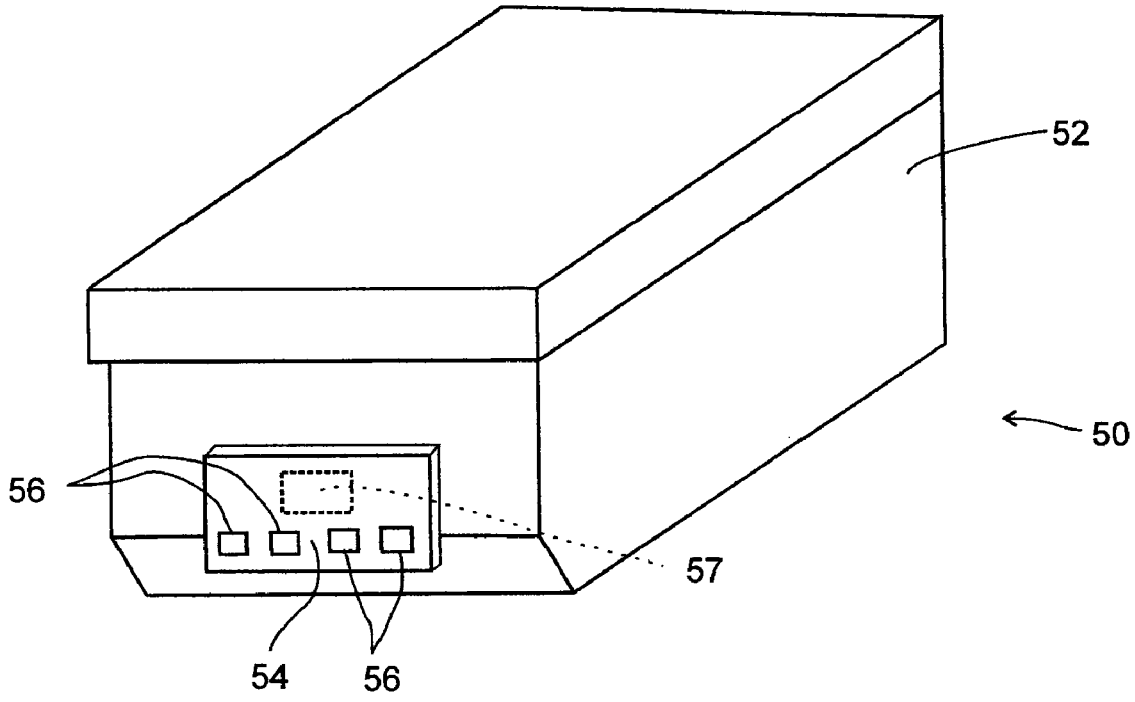
FIGS. 4*a* and 4*b* are perspective views illustrating a structure of a replaceable consumable formed in accordance with first and second embodiments.
Figure 4B:
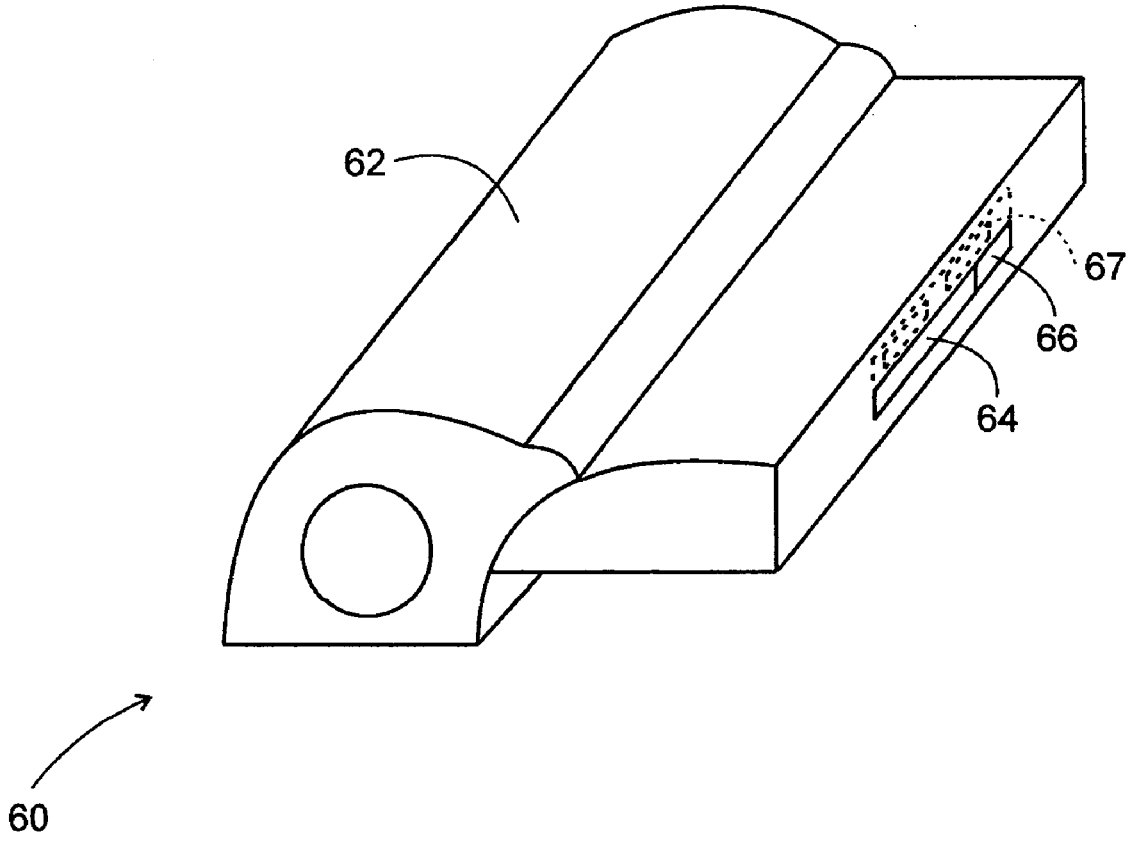

In the above regard, FIGS. 4*a* and 4*b* show preferred embodiments of the subject replaceable consumable wherein FIG. 4*a* is a perspective view illustrating a structure of a replaceable consumable in the form of an ink cartridge 50 and FIG. 4*b* shows an embodiment in the form of a toner cartridge 60. The ink cartridge 50 includes a cartridge body 52 adapted to hold ink and configured for operative connection with an associated printing device. An electronic device 54 is carried on the cartridge body 52. The electronic device includes a memory element (not shown) and a plurality of electrical contacts 56 arranged on the electronic device 54 for electromechanical connection with the associated printing device. It is to be appreciated that although a plurality of contacts are illustrated, the electronic device 54 also may include a radio frequency communication circuit 57, shown in dashed lines, for electromagnetic communication with the associated printing device rather than through use of the contacts 56 as illustrated. Preferably either electrical contacts 56 or a radio frequency communication circuit 57 are used, but not both simultaneously.

FIG. 4*b* shows a toner cartridge 60 having a toner cartridge body 62 carrying an electronic device 64. The electronic device includes a memory element (not shown) for storing data and an RF communication circuit shown schematically at 66. The RF circuit is configured for communicating data between the associated printing device (not shown) and the toner cartridge 60. It is to be appreciated that the electronic device 64 may carry a plurality of electronic contacts 67, shown in dashed lines, similar to those described above in connection with the ink cartridge. Preferably either the RF communication circuit 66 or the electronic contacts 67 are used, but not both simultaneously.

Figure 5A:
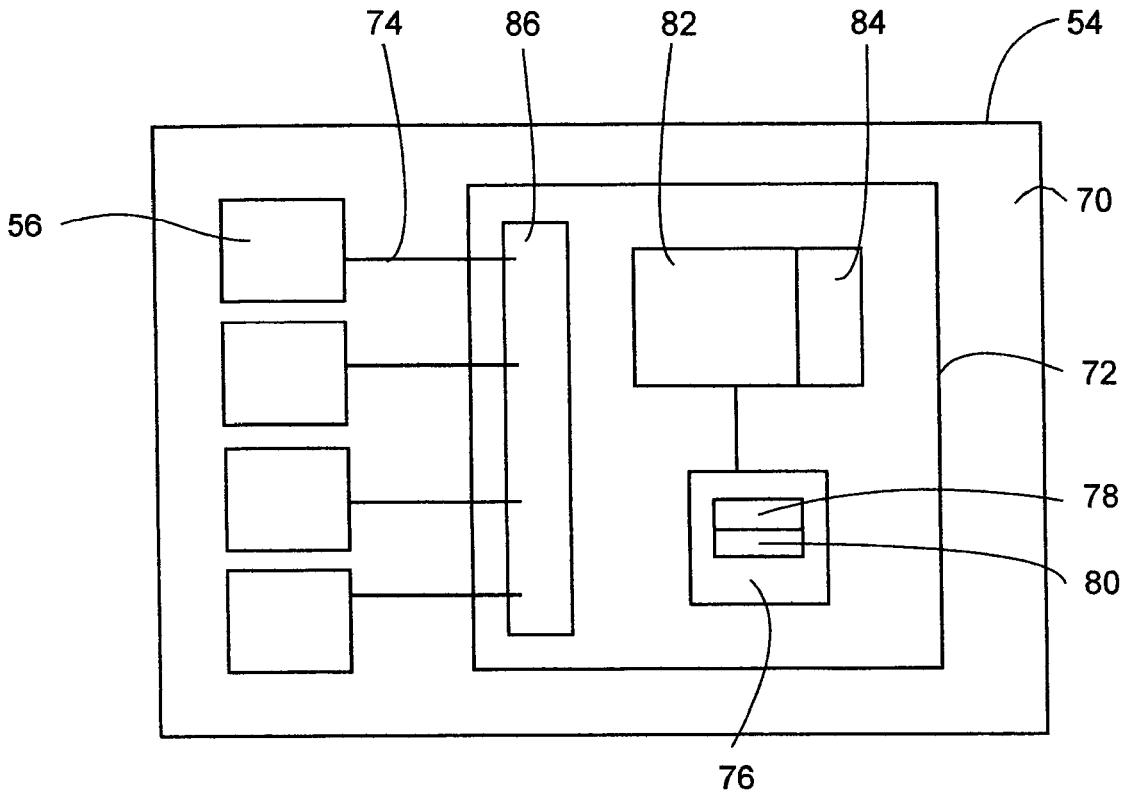
FIGS. 5*a* and 5*b* are schematic representations of electronic devices in accordance with first and second embodiments.
Figure 5B:
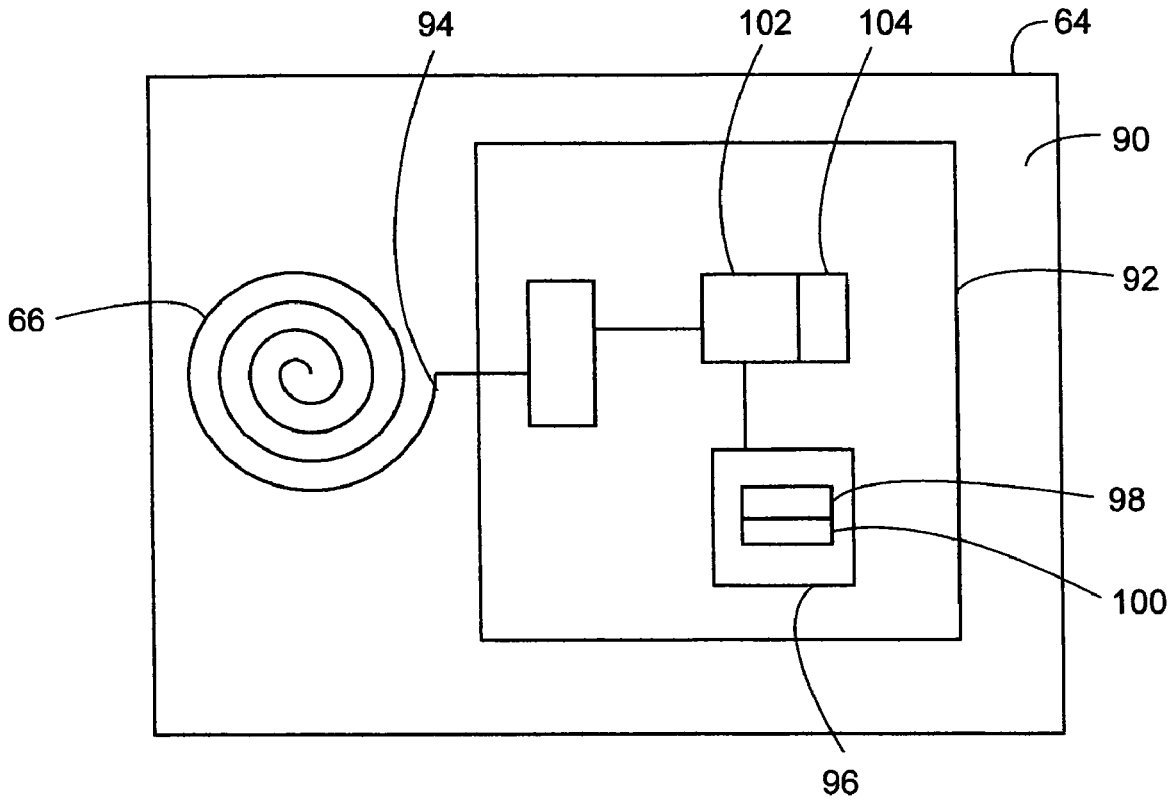

FIGS. 5*a* and 5*b* are schematic representations of the preferred form of the electronic devices 54, 64, respectively in accordance with the embodiments of the present application. It is to be appreciated that either of the preferred forms of the electronic devices 54, 64 can be provided on either the ink cartridge 50 or the toner cartridge 60 or on any other form of material dispensing device. As shown first in FIG. 5*a*, the electronic device 54 includes a printed circuit board 70 carrying a microcontroller unit (MCU) 72 thereon. The MCU 72 is connected with the plurality of electromechanical contacts 56 through suitable trace leads 74 or the like. A memory element 76 is provided within (internal) to the MCU 72 and includes at least one storage area 78 for holding a marking material quantity data and a second storage area 80 holding an incremental marking material quantity. A processing portion 82 is provided for executing software code contained in an instruction memory area 84 of the MCU 72. Lastly, an input/output buffer circuit 86 is provided for interfacing the plurality of contacts 56 with the processing portion 82 of the MCU 72.

FIG. 5*b* is a schematic representation of the electronic device 64 carried on the toner cartridge 60 and in accordance with an embodiment of the present application represented in FIG. 4*b*. As shown there, the electronic device 64 includes a printed circuit board 90 carrying a microcontroller unit (MCU) 92 and a radio frequency antenna 66. A suitable trace lead 94 is provided for connecting the radio frequency antenna 66 with the MCU 92. A memory element 96 is provided in the MCU and includes a first storage area 98 for storing marking material quantity data and a second storage area 100 for storing an incremental marking material quantity data. With continued reference to FIG. 5*b*, the MCU 92 further includes a processing portion 102 adapted to execute program instructions stored in an instruction storage portion 104.

Figure 6:
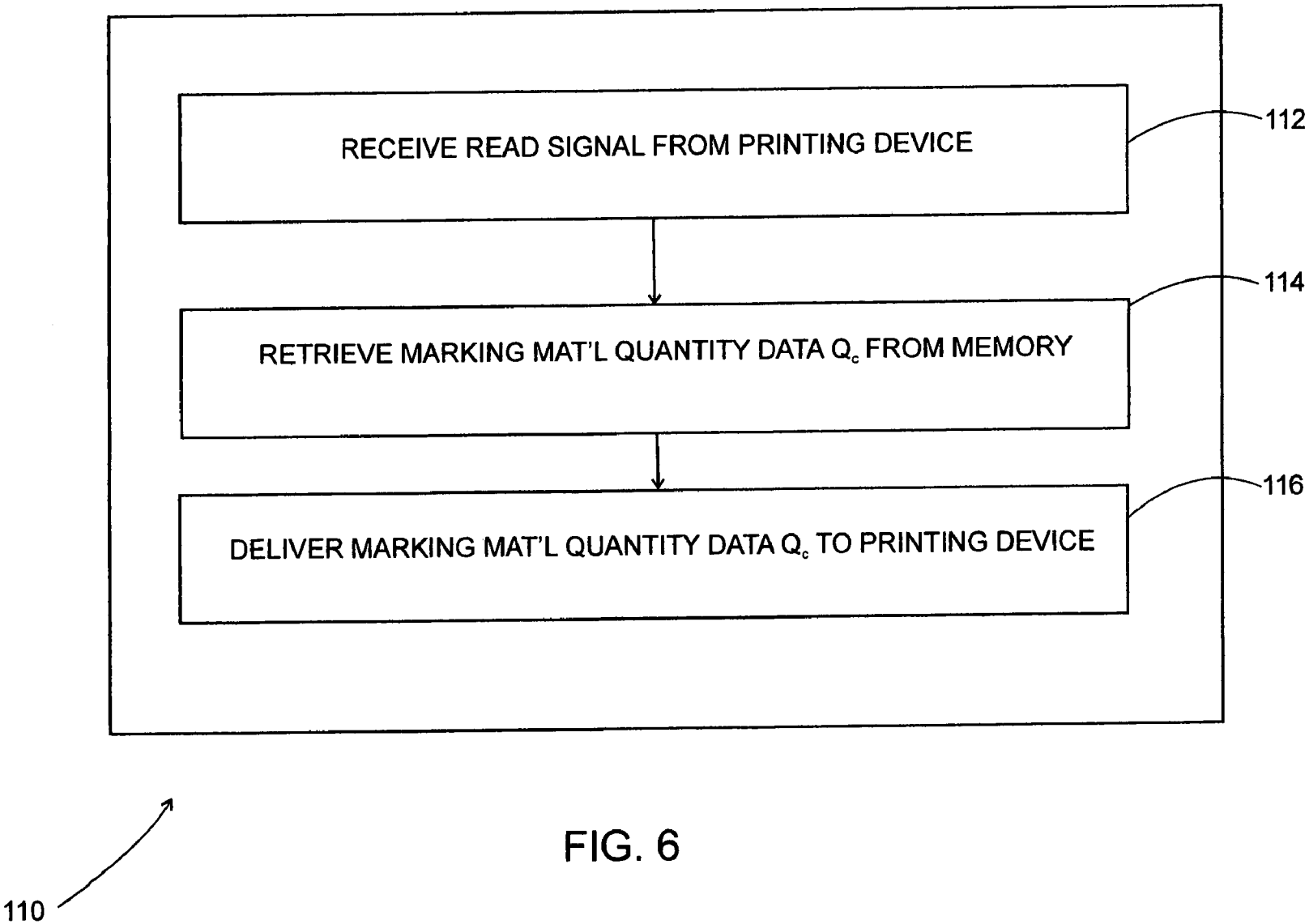
FIG. 6 is a flow chart of a read cycle.

FIG. 6 is a flow chart illustrating a preferred read sequence 110 executed by the electronic devices 54, 64 in accordance with the present application. Turning now to that figure, the read sequence 110 is initiated when the electronic device 54, 64 receives a read signal from the associated printing device at step 112. Thereafter, the MCUs 72, 92 within the electronic devices 54, 64 retrieve marking material quantity data QC from their respective memory elements 76, 96 at 114. Particularly, the marking material quantity data QC is retrieved from the first storage areas 78, 98 of the respective memory elements 76, 96. In step 116, the electronic devices 54, 64 deliver the marking material quantity data QC to the associated printing device. Essentially, the MCUs 72, 92 retrieve the marking material quantity data QC from the first storage areas 78, 98 and deliver the data to the associated printing device using the plurality of contacts 56 and interface circuit 86 or using the radio frequency antenna 66 for radio frequency communication. Overall, therefore, in the preferred form of a read cycle, the electronic devices simply react directly to commands from the associated printing device to read from memory and then deliver the marking material quantity data QC to the printing apparatus.

Figure 7:
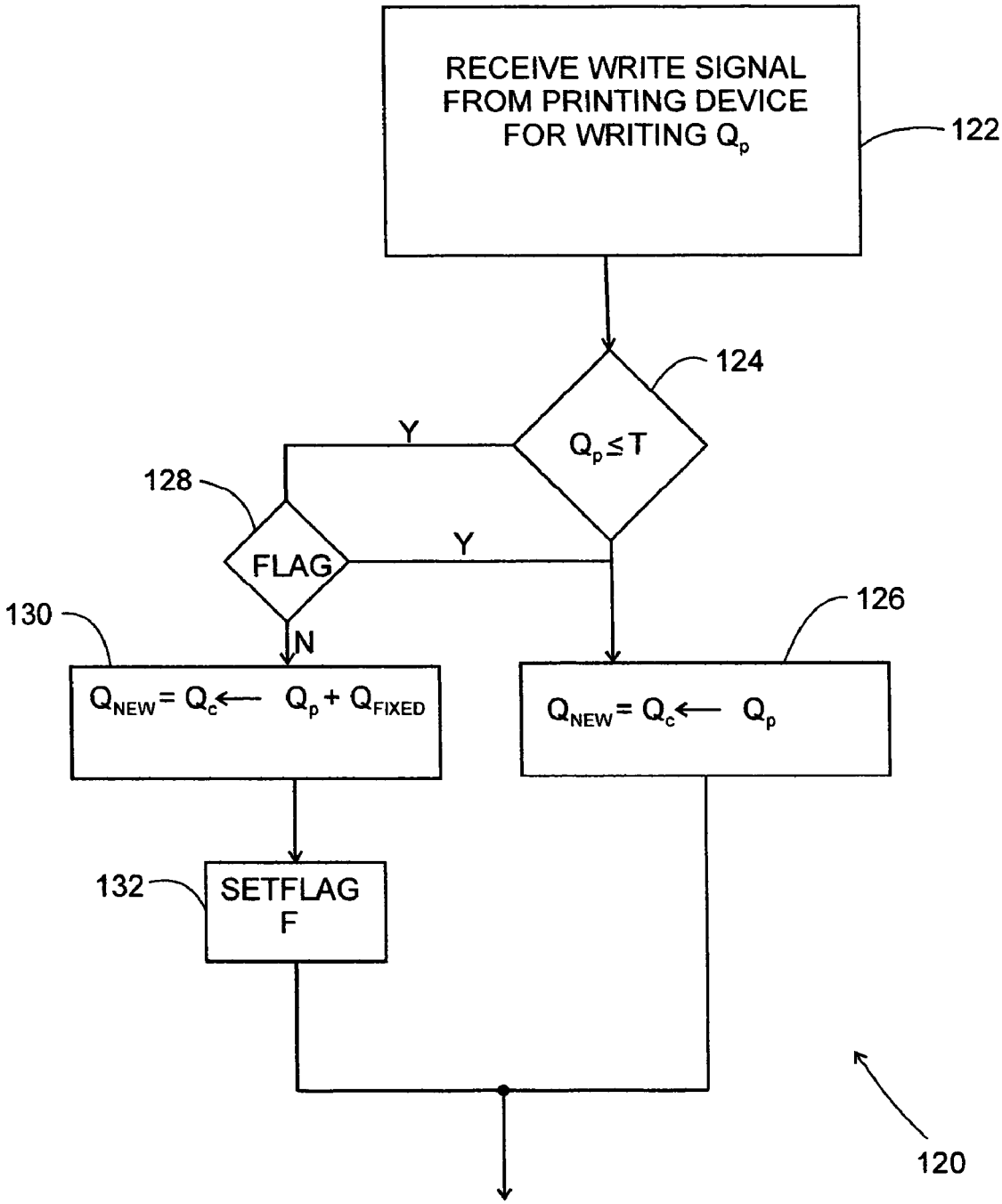
FIG. 7 is a flow chart of a write cycle.

FIG. 7 is a flow chart illustrating a preferred write cycle 120 in accordance with the present application. In the write cycle 120, the associated printing device is attempting to update or write new or updated marking material quantity data $Q_P$ into the first storage area 78, 98 for reasons understood by those skilled in the art. Essentially, in a first step of the write cycle, the electronic device 54, 64 receives a write signal from the associated printing device at step 122.

Next, at step 124, the electronic element compares the revised marking material quantity data $Q_P$ received from the associated printing apparatus with a predetermined threshold data T and, if the revised marking material quantity data $Q_P$ is less than the threshold value, the electronic device 54, 64 writes the revised marking material quantity data $Q_P$ as the new marking material data $Q_{NEW}$ in the first memory locations 78, 98 of the respective memory elements 76, 96. Essentially, the marking material quantity data $Q_C$ is replaced with the revised marking material quantity data $Q_P$ received from the associated printing apparatus. The symbol "←" means replace as in A←B, A is replaced with the value of B.

At step 124, however, if the revised marking material quantity data $Q_P$ reaches or goes below the threshold T, a high yield flag F is checked for a logical state at step 128. If the flag is already set, then the write cycle 120 continues in step 126 to essentially, again, replace the marking material quantity data $Q_C$ with the revised marking material quantity data $Q_P$ as new marking material data $Q_{NEW}$ in the first storage area 78, 98. However, when the high yield flag F is not yet set, the new marking material $Q_{NEW}$ stored in the first storage area 78, 98 becomes the revised marking material quantity data $Q_P$ summed with a predetermined non-zero incremental marking material quantity $Q_{FIXED}$. $Q_{FIXED}$ is stored in the second storage areas 80, 100 of the memory elements of the electronic devices 54, 64. Essentially, in step 130, the subject electronic devices do not write the marking material quantity data $Q_C$ into the memory locations with fidelity but, rather, at an incremental fixed amount $Q_{FIXED}$ to better synchronize the internal counters in the associated printer with an actual physical quantity of marking material contained within the cartridges.

In step 132, the high yield flag F is set and the execution path is returned to the normal flow.

Figure 8:
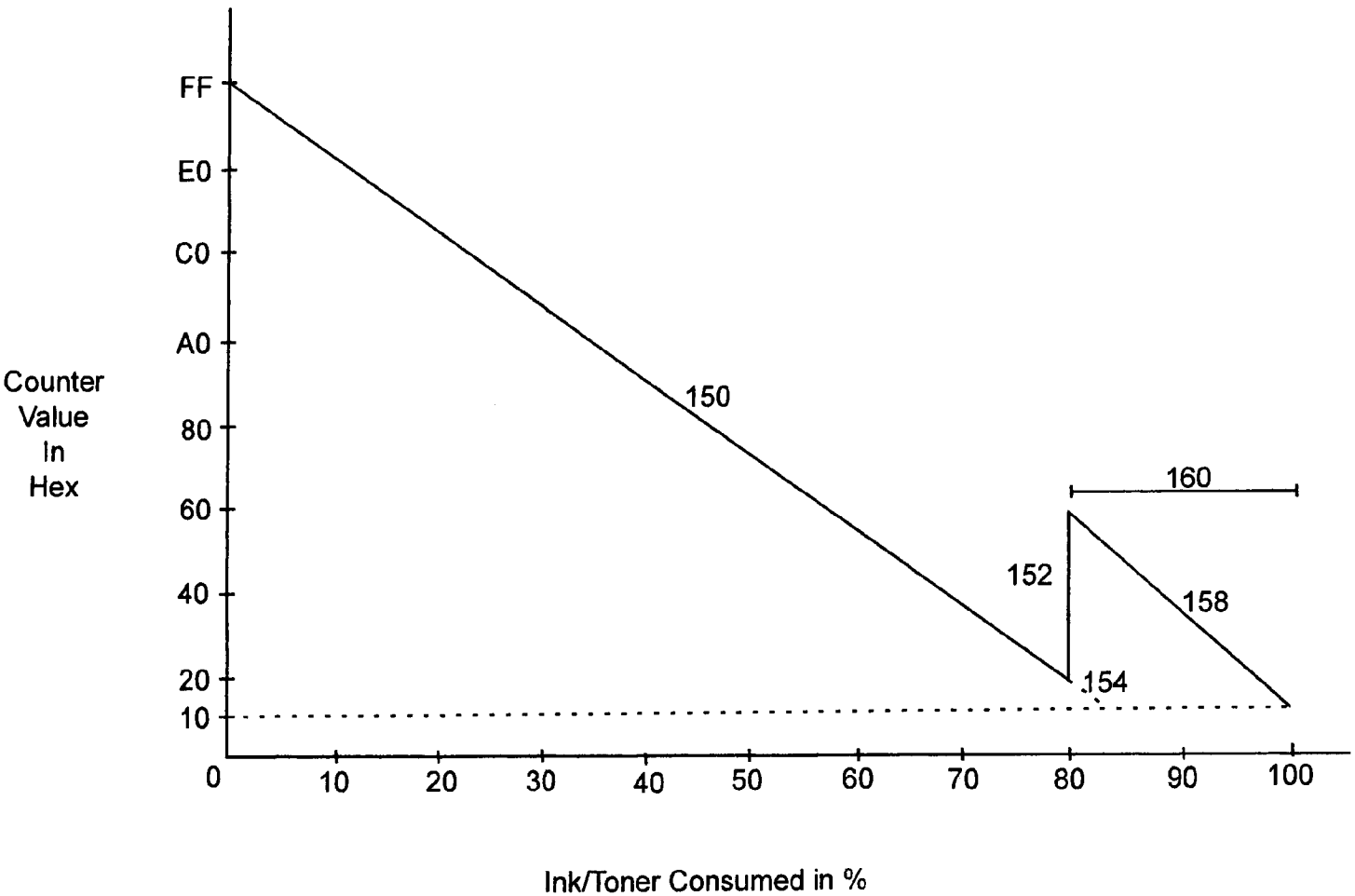
FIG. 8 is a chart showing the automatic high yield function.

FIG. 8 shows a chart illustrating the manner in which the internal counter is adjusted in accordance with the present application to compensate for increased volumes of marking material contained within the ink or toner cartridges. With reference next to that figure, a counter value FF in hexadecimal indicates a full cartridge or 0% marking material consumed. As ink or toner is consumed by the printing apparatus during normal print operations and consumed from the cartridge, the counter is decremented by data maintenance signals from the printer along the curve portion 150. At about 80% of marking material depleted from the cartridge, at said threshold T, $Q_{FIXED}$ is added to the new marking material data $Q_{NEW}$ delivered from the printer. This is illustrated in the graph in FIG. 8 in portion 152. As can be seen from the chart, the electronic member on the cartridge is responsive to the data maintenance signals from the associated printing apparatus to modify the marking material quantity data $Q_C$ in the memory element as a non-linear function of the data maintenance signal. In the prior art, as shown in the dashed line 154, the printing operations would be terminated with about 90% of the ink or toner being consumed. However, in accordance with the present application, as can be seen, the addition to the counter value of the $Q_{FIXED}$ permits the final portion of the curve 158 to extend beyond the prior art curve in an amount 160 thus consuming a larger portion of ink or toner from the cartridge.

The invention has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A replaceable consumable for use in an associated printing device to form marks on an associated substrate, the replaceable consumable comprising:

a cartridge body configured for operative connection with said associated printing device;

a marking material contained in said cartridge body, the marking material being selectively delivered to the printing device from said cartridge body to form said marks on said substrate;

a memory element coupled with the cartridge body, the memory element holding data relating to said marking material including marking material quantity data $Q_C$ representative of a quantity of said marking material in said cartridge body; and, an electronic member operatively associated with said memory element, the electronic member being responsive to read signals from the associated printing device during a read sequence to deliver said marking material quantity data $Q_C$ from said memory element to said associated printing device, and being responsive to write signals from the associated printing device during a write sequence to receive revised marking material quantity data $Q_P$ from the associated printing device, the electronic member being operative in first and second operational modes during said write sequence to selectively i) replace said marking material quantity data $Q_C$ with said revised marking material quantity data $Q_P$ as new marking material data $Q_{NEW}$ in said first operational mode according to $Q_{NEW}=Q_C \leftarrow Q_P$ and ii) replace said marking material quantity data $Q_C$ with a modified revised marking material quantity data $Q_P'$ as said new marking material data $Q_{NEW}$ in said second operational mode according to $Q_{NEW}=Q_C \leftarrow Q_P'$, where $Q_P' \neq Q_P$.

2. The replaceable consumable according to claim 1 wherein:

in said second operational mode, said electronic member is responsive to said write signals from the associated printing device to replace said marking material quantity data $Q_C$ in said memory element with said modified revised marking material quantity data $Q_P'$ according to $Q_{NEW}=Q_C \leftarrow Q_P'=Q_P+Q_{FIXED}$ wherein $Q_{FIXED}$ is a predetermined non-zero incremental marking material quantity.

3. The replaceable consumable according to claim 2 wherein at least one of said memory element and said electronic member is adapted to store said incremental marking material quantity data $Q_{FIXED}$.

4. The replaceable consumable according to claim 2 wherein:

said incremental marking material quantity data $Q_{FIXED}$ is stored in said memory element; and, said electronic member is adapted to selectively modify the incremental marking material data.

5. The replaceable consumable according to claim 2 wherein:

said electronic member is responsive to said read signals from the associated printing device during said read sequence to deliver said new marking material quantity data $Q_{NEW}$ to said associated printing device.

6. The replaceable consumable according to claim 2 wherein said electronic member and said memory element are integrated into a single microcontroller unit (MCU) device coupled with said cartridge body.

7. The replaceable consumable according to claim 6 wherein said incremental marking material quantity data $Q_{FIXED}$ is stored in a data memory portion of said microcontroller unit device.

8. The replaceable consumable according to claim 6 wherein said incremental marking material quantity data $Q_{FIXED}$ is stored in a program memory portion of said microcontroller unit device.

9. The replaceable consumable according to claim 8 further including communication interface means for interfacing said microcontroller unit device with said associated printing device to communicate said read and write signals therebetween.

10. The replaceable consumable according to claim 9 wherein said communication interface means includes electrical contact pads adapted to engage electrical contact pins on said associated printing device when said cartridge body is in said operative connection with said associated printing device to exchange said read and write signals therebetween as electrical signals.

11. The replaceable consumable according to claim 9 wherein said communication interface includes a radio frequency (RF) circuit adapted to communicate with an associated RF circuit on said associated printing device to exchange said read and write signals therebetween as electromagnetic signals.

12. The replaceable consumable according to claim 1 wherein said marking material is ink.

13. The replaceable consumable according to claim 1 wherein said marking material is toner.

14. The replaceable consumable according to claim 1 wherein:

said memory element holds marking material threshold data T relating to a predetermined quantity of said marking material contained in said cartridge (considered to be near empty);

said electronic member is adapted to compare said revised marking material quantity data $Q_P$ received from said associated printing device with said marking material threshold data T.

15. A replaceable consumable for use in an associated printing device to form marks on an associated substrate, the replaceable consumable comprising:

a cartridge body configured for operative connection with said associated printing device;

a marking material contained in said cartridge body, the marking material being selectively delivered to the printing device from said cartridge body to form said marks on said substrate;

a memory element coupled with the cartridge body, the memory element holding data relating to said marking material including marking material quantity data $Q_C$ representative of a quantity of said marking material in said cartridge body; and, an electronic member operatively associated with said memory element, the electronic member being responsive to read signals from the associated printing device during a read sequence to deliver said marking material quantity data $Q_C$ from said memory element to said associated printing device, and being responsive to write signals from the associated printing device during a write sequence to receive revised marking material quantity data $Q_P$ from the associated printing device, the electronic member being operative in first and second operational modes during said write sequence to selectively i) replace said marking material quantity data $Q_C$ with said revised marking material quantity data $Q_P$ as new marking material data $Q_{NEW}$ in said first operational mode according to $Q_{NEW}=Q_C \leftarrow Q_P$ and ii) replace said marking material quantity data $Q_C$ with a modified revised marking material quantity data $Q_P'$ as said new marking material data $Q_{NEW}$ in said second operational mode according to $Q_{NEW}=Q_C \leftarrow Q_P'$, where $Q_P' \neq Q_P$;

wherein said memory element holds marking material threshold data T relating to a predetermined quantity of said marking material contained in said cartridge (considered to be near empty);

wherein said electronic member is adapted to compare said revised marking material quantity data $Q_P$ received from said associated printing device with said marking material threshold data T; and wherein said electronic member is adapted to transition between said first and second modes based on said comparison between said revised marking material quantity data $Q_P$ and said marking material threshold data T.

16. The replaceable consumable according to claim 15 wherein:

said electronic member is adapted to transition from said first operational mode to said second operational mode when said revised marking material quantity data $Q_P$ is less than said marking material threshold data T.

17. The replaceable consumable according to claim 16 wherein:

said electronic member is operative in said second operational mode to set a high yield flag F after replacing said marking material quantity data $Q_C$ with said modified revised marking material quantity data $Q_P'$ as said new marking material data $Q_{NEW}$.

18. The replaceable consumable according to claim 17 wherein:

said electronic member is operative in said second operational mode to replace said marking material quantity data $Q_C$ with said modified revised marking material quantity data $Q_P'$ only when said high yield flag F is not set (cleared).

19. A replaceable consumable for use in an associated printing device to form marks on an associated substrate, the replaceable consumable comprising:

a cartridge body configured for operative connection with said associated printing device;

a marking material contained in said cartridge body, the marking material being selectively delivered to the printing device from said cartridge body to form said marks on said substrate;

a memory element coupled with the cartridge body, the memory element holding data relating to said marking material including marking material quantity data $Q_C$ representative of a quantity of said marking material in said cartridge body; and, an electronic member operatively associated with said memory element, the electronic member being responsive to read signals from the associated printing device during a read sequence to deliver said marking material quantity data $Q_C$ from said memory element to said associated printing device, and being responsive to write signals from the associated printing device during a write sequence to receive incremental marking material quantity data $Q_{USED}$ from the associated printing device representative of an incremental amount of marking material used, the electronic member being operative in first and second operational modes during said write sequence to selectively i) replace said marking material quantity data as $Q_C$ a new marking material data $Q_{NEW}$ in said first operational mode according to $Q_{NEW}=Q_C \leftarrow$ ($Q_C - Q_{USED}$) and ii) replace said marking material quantity data $Q_C$ with said new marking material data $Q_{NEW}$ in said second operational mode according to $Q_{NEW} = Q_C \leftarrow (Q_C - Q_{USED} + Q_{FIXED})$.

20. The replaceable consumable according to claim 19 wherein:

in said second operational mode, said electronic member is responsive to said write signals from the associated printing device to replace said marking material quantity data $Q_C$ in said memory element with said new marking material quantity data $Q_{NEW}$ according to $Q_{NEW} = Q_C - Q_{USED} + Q_{FIXED}$ wherein $Q_{FIXED}$ is a predetermined non-zero incremental marking material quantity.

21. The replaceable consumable according to claim 20 wherein said memory element is adapted to store said incremental marking material quantity data $Q_{FIXED}$.

22. The replaceable consumable according to claim 20 wherein said electronic member is adapted to modify said incremental marking material quantity data $Q_{FIXED}$ stored in said memory element.

23. The replaceable consumable according to claim 20 wherein:

said electronic member is responsive to said read signals from the associated printing device during said read sequence to deliver said new marking material quantity data $Q_{NEW}$ to said associated printing device.

24. The replaceable consumable according to claim 19 wherein said marking material is ink.

25. The replaceable consumable according to claim 19 wherein said marking material is toner.

26. The replaceable consumable according to claim 19 wherein said electronic member and said memory element are integrated into a single microcontroller unit (MCU) device coupled with said cartridge body.

27. The replaceable consumable according to claim 26 further including communication interface means for interfacing said microcontroller unit device with said associated printing device to communicate said read and write signals therebetween.

28. The replaceable consumable according to claim 27 wherein said communication interface means includes electrical contact pads adapted to engage electrical contact pins on said associated printing device when said cartridge body is in said operative connection with said associated printing device to exchange said read and write signals therebetween as electrical signals.

29. The replaceable consumable according to claim 27 wherein said communication interface includes a radio frequency (RF) circuit adapted to communicate with an associated RF circuit on said associated printing device to exchange said read and write signals therebetween as electromagnetic signals.

30. A replaceable consumable for use in an associated printing device to provide marks on an associated substrate, the replaceable consumable comprising:

a cartridge body configured for connection with said associated printing device;

a marking material contained within said cartridge body, the marking material being selectively delivered to the printing device from said cartridge body in response to print command signals generated by the associated printing device to provide marks on the associated substrate; and, an electronic member on the cartridge body and configured to receive data maintenance signals from said associated printing device representative of a calculated quantity of marking material remaining in the cartridge body determined by the printing device, the electronic member having a memory element storing marking material quantity data corresponding to a quantity of said marking material contained in said cartridge body, the electronic member being responsive to said data maintenance signals to modify said marking material quantity data in said memory element as a non-linear function of said data maintenance signal.

* * * * *